US006516548B2

(12) United States Patent
Lage et al.

(10) Patent No.: US 6,516,548 B2
(45) Date of Patent: Feb. 11, 2003

(54) INJECTION MOLDED CONTAINER AND PROCESS FOR MAKING SAME

(75) Inventors: David P. Lage, Manchester, MO (US); John G. Goessling, Ladue, MO (US)

(73) Assignee: Quick Point, Inc., Fenton, MO (US)

( * ) Notice: Subject to any disclaimer, the term of this patent is extended or adjusted under 35 U.S.C. 154(b) by 147 days.

(21) Appl. No.: 09/767,430

(22) Filed: Jan. 22, 2001

(65) Prior Publication Data

US 2002/0095830 A1 Jul. 25, 2002

(51) Int. Cl.[7] ..... G09F 3/00

(52) U.S. Cl. ..... 40/324; 40/310; 40/312; 40/328; 40/329

(58) Field of Search ..... 40/324, 310, 312, 40/328, 329

(56) References Cited

U.S. PATENT DOCUMENTS

| | | | | |
|---|---|---|---|---|
| 2,328,338 A | | 8/1943 | Hauptman | |
| 2,376,064 A | | 5/1945 | Knapp | |
| 2,689,424 A | | 9/1954 | Clagett | |
| 2,805,787 A | | 9/1957 | Sherman | |
| 3,490,634 A | | 1/1970 | Reyburn | |
| 4,388,058 A | | 6/1983 | Kubo | |
| 4,402,195 A | | 9/1983 | Campbell | |
| 4,789,073 A | | 12/1988 | Fine | |
| 4,928,412 A | | 5/1990 | Nishiyama | |
| 5,040,317 A | | 8/1991 | Kadjevich | |
| 5,398,842 A | * | 3/1995 | Sokolski et al. | 220/367.1 |
| 5,466,413 A | | 11/1995 | Richter et al. | |
| 5,525,383 A | * | 6/1996 | Witkowski | 229/400 |
| 5,593,053 A | * | 1/1997 | Kaufman et al. | 215/12.1 |
| 5,653,124 A | * | 8/1997 | Weber | 62/457.3 |
| 5,769,262 A | * | 6/1998 | Yamada et al. | 215/13.1 |
| 5,769,311 A | | 6/1998 | Morita et al. | |
| 5,839,599 A | | 11/1998 | Lin | |
| 5,894,948 A | | 4/1999 | Yeh | |
| 5,904,267 A | * | 5/1999 | Thompson | 215/12.1 |
| 5,944,931 A | | 8/1999 | Cranford | |
| 6,230,638 B1 | * | 5/2001 | Ownbey et al. | 112/302 |

* cited by examiner

*Primary Examiner*—Stephen T. Gordon
*Assistant Examiner*—Lori L Coletta
(74) *Attorney, Agent, or Firm*—Polster, Lieder, Woodruff & Lucchesi, L.C.

(57) ABSTRACT

The present invention provides an economical process for forming a plastic integral product having a protected advertising surface and the resulting product which contains an indicia or imprint which is completely protected from the possibility of damage. The product has an interior liner and an exterior integral transparent or translucent layer to allow unimpeded viewing of any imprint placed on the exterior of the liner. Furthermore, the product provides an attractive, completely integral product having a protected advertising surface. An example of the integral product is in the form of a tumbler, a mug, a cup, a coaster, a coin dish or the like.

26 Claims, 2 Drawing Sheets

INJECTION MOLDED CONTAINER AND PROCESS FOR MAKING SAME

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a multi-step process for forming a protected advertising surface on a container or other product and to the product having the protected advertising surface. In a preferred example, a drinking vessel has an inner liner formed by injection molding; an imprint is placed on the exterior of the liner and the exterior of the liner and its rim are encompassed and bonded with a translucent or transparent plastic to form an integral drinking vessel with an imprint visible from the exterior but protected from exterior or interior damage. The same process may be applied to a different type of product or container such as a coaster or a change dish or a lid and the like, to provide a protected advertising surface.

Most advertising surfaces, for example, thermal drinking vessels, which exhibit a decal or design are formed from two separate parts laminated or sealed after the decal has been placed between the parts prior to sealing. Such vessels tend to chip or the seal becomes broken so that the thermal properties are lost and the decal or design becomes damaged or dislodged. Many products have the design or logo printed or otherwise affixed to the exterior of the product whereupon the design itself wears or becomes damaged.

U.S. Pat. No. 5,894,948 to F. Yeh provides a mug assembly with an internal mug adapted to be positioned inside an external mug, the latter of which is transparent. The internal mug is made of a non-plastic material which is ceramic, porcelain, stoneware, earthenware or glass. A sealing method or material secures the internal mug inside the external mug. Decorative indicia may be provided between the inner of the external mug and the outer surface of the internal mug. Although this assembly technique may appear simple, it has the drawback mentioned above where the seal can become broken and the imprint or decal damaged.

U.S. Pat. No. 5,944,931 to G. Cranford, provides a method for printing a sublimation transfer on a container having a handle, such as a cup or mug. The length of the transfer is sufficient to completely encircle the outer surface of the mug. The sublimation transfer is pressed against the mug and heat is applied to transfer the printing to the mug. The design of the transfer allows printing to completely encircle the mug. However, the transfer is on the exterior of the mug and is easily subjected to damage.

The present invention provides an economical process for forming a protected advertising surface as a part of a container, e.g., a drinking vessel, a coaster, a coin container or the like and further resides in the advertising surface protected product itself. As an example, the drinking vessel has an interior liner, which can be opaque, translucent, or transparent, and an exterior integral transparent or translucent layer to allow unimpeded viewing of any indicia placed on the exterior of the liner. Furthermore, the drinking vessel provides an attractive, completely integral vessel for consumption of warm and cold beverages. The vessel may be in the form of a tumbler, a mug, or a cup or the like.

SUMMARY OF THE INVENTION

The present invention provides a process for preparing an injection molded product having a protected advertising surface, generally a container, which process comprises forming in a first injection mold a liner from a plastic material, the liner having a bottom, an interior, an exterior and a rim. The liner is removed from the injection mold, imprinted with indicia on its exterior, and placed in a second injection mold. In a second injection mold, an outer layer of plastic material is provided to surround and fuse to the exterior of the liner including the rim and bottom to provide an integral container. The plastic in the second mold will be translucent or transparent so that the imprint on the interior liner will be visible from the outside of the container and completely protected by the outer layer. The two parts fuse in the second molding step to make an integral item without any bonding agent. The final product cannot be separated into the liner layer and the exterior layer but remains a unitary item.

A protected advertising surface is an interior surface of a multilayer product which surface is receptive of indicia or other design and which can be viewed from the exterior of the product while being completely protected from the possibility of damage.

Suitable plastic material may be used to form the liner and the outer layer. Among suitable plastic materials are acrylics, styrenes, polycarbonates, and combinations thereof. Particularly suitable plastic materials are styrene acrylonitrile (SAN) and acrylics.

The present invention also provides an integral injection molded product having a protected advertising surface which comprises a plastic liner having a bottom, an interior, an exterior and a rim. The exterior of the liner may have either a jut out or tab adjacent the rim, or the interior may have a vertical small flat edge or other design, to be used solely as a registration point for placement of indicia. The registration point may also be used as a registration point for the second mold. Any of these types of registration points permits accurate location of any indicia or imprint placed on the exterior of the liner with respect to placement of the liner in the second injection mold for making the final product. This is particularly true when the product is a mug, cup, or the like where the shape is not completely symmetrical. An injection molded outer layer of translucent or transparent plastic material surrounds and fuses to the exterior of the liner including the rim to provide an integral container with a visible imprint.

DETAILED DESCRIPTION OF THE INVENTION

Figure 1:
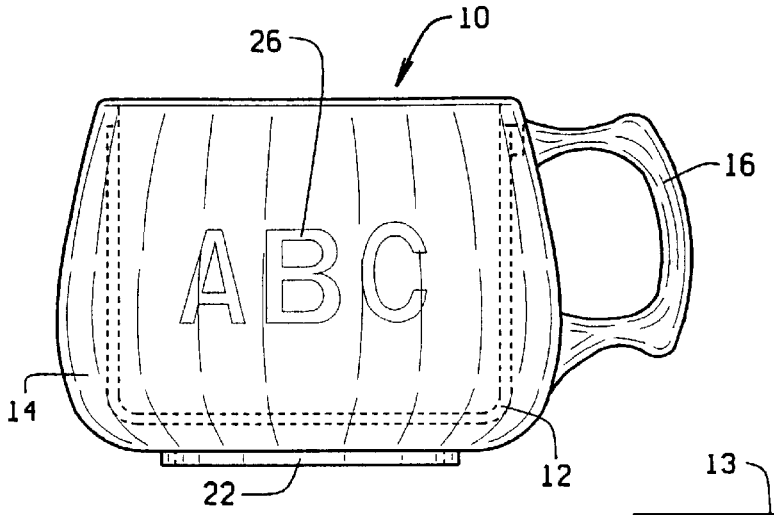
FIG. 1 is a front elevational view of one embodiment of the present invention.
Figure 2:
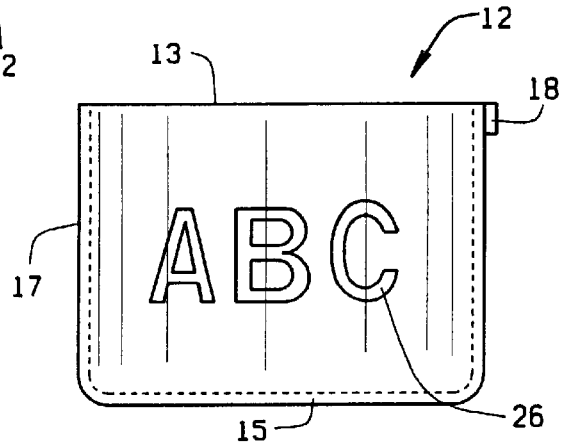
FIG. 2 is a front elevational view of a liner of one embodiment of the present invention.

FIG. 1 is a side elevational view of a mug 10, having a liner 12. The liner 12 depicted in FIG. 2 is formed in a first injection mold and removed therefrom. The liner 12 is then placed in a second injection mold wherein the rest of the mug 10 is molded around the liner 12 to provide the mug exterior 14, a base 22 and a handle 16 all of which are integral to form the mug 10.

FIG. 2 is a side elevational view of the liner 12 having an exterior 17, a bottom 15 and a rim 13. In addition, the liner 12 has a tab or jut out 18 at the top of the liner 12 on one side of the liner 12. The tab 18 allows the location of the liner 12 to be properly oriented when the liner 12 is placed in the second injection mold. This allows accurate registration of any indicia or imprint 26 on the exterior of the liner 12 which appears through the translucent or transparent exterior 14 of the mug 10. However, orientation is not required for a tumbler.

Figure 3:
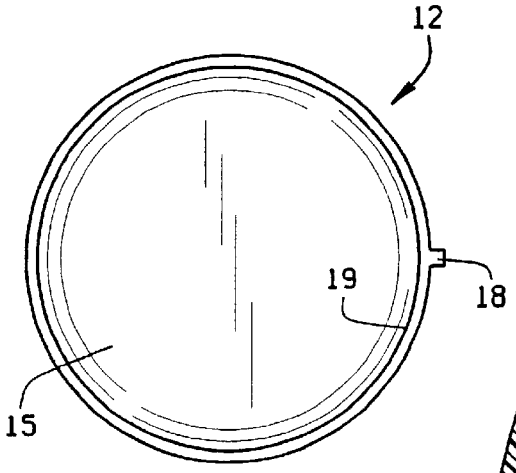
FIG. 3 is a top plan view of the liner of FIG. 2.

FIG. 3 is a top plan view of the liner 12, having an interior 19, and clearly depicting the tab 18 with respect to placement on the exterior 17 of the liner 12.

Figure 4:
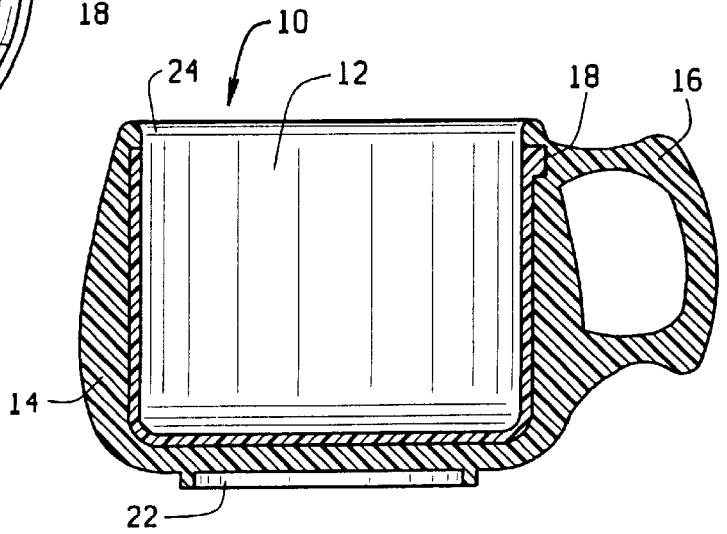
FIG. 4 is a side elevational view of a vertical section taken through the mid-point of the handle and embodiment of FIG. 1.

FIG. 4 is a side elevational view of a vertical section taken through the mid-point of the handle and embodiment of FIG. 1. This section view of the mug 10 allows a further understanding of the relationship of the liner 12 with its tab 18 with respect to registration of the imprint 26 in relation to the handle 16 as desired by the manufacturer. The tab 18 interlocks with corresponding locations (not shown here) in the second injection mold. This accurate placement of the liner 12 in the second injection mold allows formation of the handle 16 consistently with relation to the imprint 26 and the rest of the mug 10. The imprint 26 may extend all around the mug 10 or may be located on both sides of the mug 10 or just one side of the mug 10 as illustrated here. The rim 24 of the mug 10 extends over the rim 13 of the liner 12. Thus the exterior 14 of the mug 10 formed in the second injection mold, covers and is fused to the liner exterior 17, the liner bottom exterior 15, the tab 18 and the liner rim 13 to form the integral mug 10.

Figure 5:
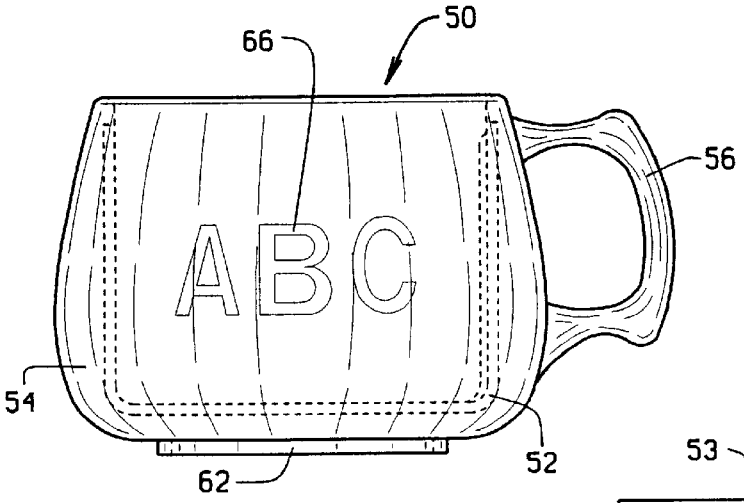
FIG. 5 is a front elevational view of another embodiment of the present invention.
Figure 6:
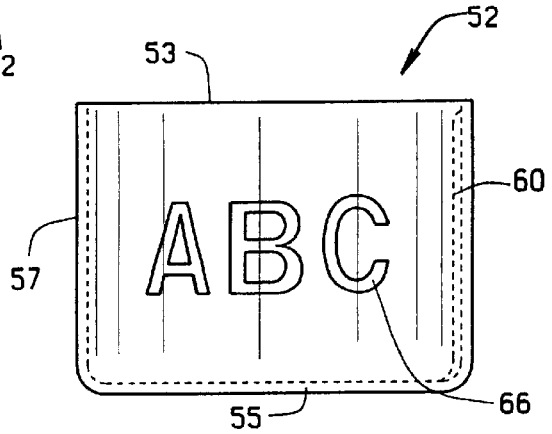
FIG. 6 is a front elevational view of a liner of another embodiment of the present invention.

FIG. 5 is a side elevational view of a mug 50, having a liner 52. The liner 52 depicted in FIG. 6 is formed in a first injection mold and removed therefrom. The liner 52 is then placed in a second injection mold wherein the rest of the mug 50 is molded around the liner 52 to provide the mug exterior 54, a base 62 and a handle 56 all of which are integral to form the mug 50.

FIG. 6 is a side elevational view of the liner 52 having an exterior 57, a bottom 55 and a rim 53. In addition, the interior 59 of the liner 52 has a vertical small flat edge 60. The vertical small flat edge 60 allows the location of the liner 52 to be properly oriented when the liner 52 is placed in the second injection mold. This allows accurate registration of any indicia or imprint 66 on the exterior of the liner 52 which appears through the translucent or transparent exterior 54 of the mug 50.

Figure 7:
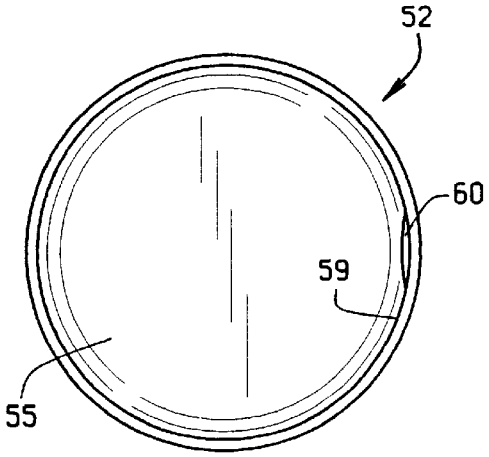
FIG. 7 is a top plan view of the liner of FIG. 6.

FIG. 7 is a top plan view of the liner 52 clearly depicting the vertical small flat edge 60 with respect to placement on the interior 59 of the liner 52. The vertical small flat edge 60 need not extend the entire height of the interior of the liner 52, however, aesthetically, the extension of the vertical small flat edge 60 for most of the height of the liner 52 is desirable.

Figure 8:
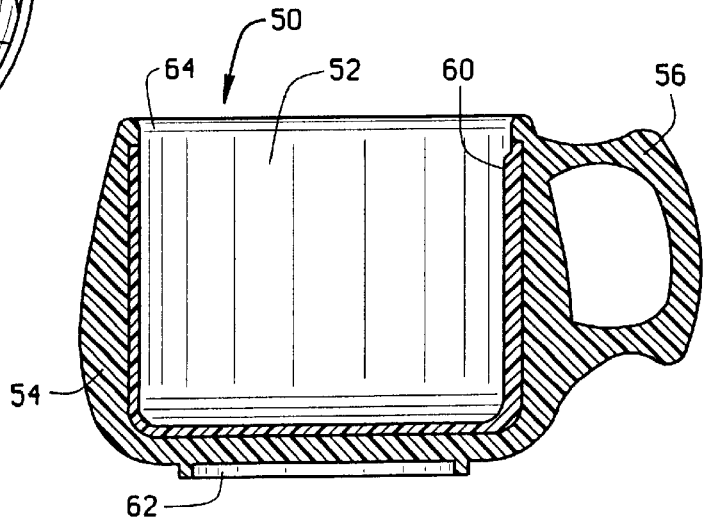
FIG. 8 is a side elevational view of a vertical section taken through the mid-point of the handle and embodiment of FIG. 4.

FIG. 8 is a side elevational view of a vertical section taken through the mid-point of the handle and embodiment of FIG. 5. This section view of the mug 50 allows a further understanding of the relationship of the liner 52 with the vertical small flat edge 60 with respect to registration of the imprint 66 in relation to the handle 56 as desired by the manufacturer. The vertical small flat edge 60 interfaces with a corresponding flat edge (not shown here) in the second injection mold. This accurate placement of the liner 52 in the second injection mold allows formation of the handle 56 consistently with relation to the imprint 66 and the rest of the mug 50. The imprint 66 may extend all around the mug 50 or may be located on both sides of the mug 50 or just one side of the mug 50 as illustrated here. The rim 64 of the mug 50 extends over the rim 53 of the liner 52. Thus the exterior 54 of the mug 50 formed in the second injection mold, covers and is fused to the liner exterior 57, the liner bottom exterior 55, and the liner rim 53 to form the integral mug 50.

EXAMPLE 1

Styrene acrylonitrile in the form of a commercial product identified as SAN is prepared by known procedures for a first injection mold. The styrene acrylonitrile material may contain color dye or other suitable materials to make the liner 12 opaque, solid in appearance, translucent or transparent. The SAN is injected into the first mold at a predetermined temperature suitable for injection molding of the styrene acrylonitrile polymer. The injection molding step generally ranges from about one to about three minutes depending on the desired thickness of the product liner 12. The liner 12 is then removed from the mold. The liner 12 contains tab 18 as described heretofore.

Any desired imprint or indicia is placed on the exterior 17 of the liner by suitable means. For example, the imprint may be effected in ink, e.g., Nasdar screen ink, or pad print accomplished by screen printing or in the form of a printed paper, decal or the like. The imprint indicia is secured, if necessary, to the outside 17 of the liner 12.

The liner 12 is placed in a second injection mold, or alternatively in a second compartment of the first mold, with the tab 18 properly aligned with the corresponding negative registries, i.e., a notch for the tab 18 of the liner 12.

A suitable styrene acrylonitrile material or an acrylic material, containing the desired dyes for color is loaded to be dispensed through the second injection mold at the predetermined temperatures and times outlined above. The plastic material injected into the second mold covers the liner exterior 17, liner bottom exterior 15, and the liner rim 13. In addition, the second mold contains die space for the mug base 22 and handle 16 to form a completed mug. The finished mug 10 is then removed from the mold, cooled, and is ready for shipment or sale.

The exterior of the second mold may be highly polished to provide excellent clarity of the mug exterior 14 thus making any indicia or imprint 26 on the liner 12 highly visible. If desired, an additional imprint may be added to the outside of the mug over the internal imprint to provide a 3-D effect, however, such an imprint is not protected from external wearing, scratching and other destruction without further treatment.

By merely changing the die of the mold, other drinking vessels may be produced by the process of the present invention. For instance, a more conventional cup design may be formed. The same process steps may be employed and if desired, the same type of registration tabs may be used. The registration tab may be placed at any appropriate location on the liner so long as the mug exterior 14 covers the tab 18 to provide a smooth exterior 14 of the mug 10.

In addition, a tumbler is easily formed and does not require the tab for registration of a handle. A tumbler does not have a handle and because it exhibits complete symmetry, the indicia does not ordinarily require registration, however, if there are multi color portions of the indicia, some form of registration may be necessary.

EXAMPLE 2

Acrylic in the form of a commercial product is prepared by known procedures for a first injection mold. The acrylic material may contain color dye or other suitable materials to make the liner 52 opaque, solid in appearance, translucent or transparent. The acrylic material is injected into the first mold at a predetermined temperature suitable for injection molding of the acrylic polymer. The injection molding step generally ranges from about one to about three minutes depending on the desired thickness of the product liner 52. The liner 52 is then removed from the mold. The liner 52 contains the vertical small flat edge 60 as described heretofore.

Any desired imprint or indicia is placed on the exterior 57 of the liner by suitable means. The imprint indicia is secured, if necessary, to the outside 57 of the liner 52.

The liner 52 is placed in a second injection mold, or alternatively in a second compartment of the first mold, with the vertical small flat edge 60 properly aligned with the corresponding flat edge registry in the mold.

A suitable acrylic material, containing the desired dyes for color is loaded to be dispensed through the second injection mold at the predetermined temperatures and times outlined above. The plastic material injected into the second mold covers the liner exterior 57, liner bottom exterior 55, and the liner rim 53. In addition, the second mold contains die space for the mug base 62 and handle 56 to form a completed mug. The finished mug 50 is then removed from the mold, cooled, and is ready for shipment or sale.

By merely changing the die of the mold, other articles having the protected advertising surface, may be produced by the process of the present invention. For instance, a taller vessel simulating a tumbler, but with a handle may be formed. The same process steps may be employed and the same type of vertical small flat edge may be used for registry of any indicia. The vertical small flat edge may be placed at any appropriate location on the interior of the liner so long as the second mold has a corresponding vertical flat edge. Although either the tab or the vertical small flat edge may be used to satisfactorily register the second mold with the liner, other registration forms would be suitable and are included herein.

Other products upon which protected advertising surfaces are desirable, are containers which include change dishes, lids and/or coasters for drinking vessels, candy dishes or dishes of any type, or the like. The protected "advertising" surface may also be simply a design and therefore is not used exclusively for advertising.

Although the invention has been described in considerable detail in the foregoing, it is to be understood that such detail is solely for the purpose of illustration and that variations can be made without departing from the spirit and scope of the invention.

What is claimed is:

1. A process for preparing an injection molded product having a protected advertising surface comprising:

(a) forming in a first injection mold a liner from a plastic material, the liner having a bottom, an interior, an exterior and a rim;

(b) removing the liner from the injection mold;

(c) placing an indicia on the exterior of the liner;

(d) placing the liner in a second injection mold; and (e) forming an injection molded outer layer of plastic material surrounding and fused to the exterior of the liner including the rim to provide an integral product having a protected advertising surface.

2. The process of claim 1 wherein the outer layer is translucent or transparent so as to be able to view the indicia.

3. The process of claim 1 wherein the indicia is formed in ink, or by screen printing, or in the form of a printed paper or decal.

4. The process of claim 1 wherein the plastic material includes acrylics, styrenes, polycarbonates, a combination of acrylics and styrenes, a combination of polycarbonates and acrylics, a combination of styrenes and polycarbonates, or a combination of acrylics, styrenes and polycarbonates.

5. The process of claim 1 wherein the plastic material is a thermoplastic material.

6. The process of claim 5 wherein the thermoplastic material is styrene acrylonitrile or acrylic.

7. The process of claim 1 wherein the product is a container.

8. A process for preparing an injection molded container having a protected advertising surface comprising:

(a) forming in a first injection mold a liner from a plastic material, the liner having a bottom, an interior, an exterior and a rim;

(b) removing the liner from the injection mold;

(c) placing an indicia on the exterior of the liner;

(d) placing the liner in a second injection mold; and (e) forming an injection molded outer layer of plastic material surrounding and fused to the exterior of the liner including the rim to provide an integral container having a protected advertising surface.

9. The process of claim 8 wherein the outer layer is translucent or transparent so as to be able to view the indicia.

10. The process of claim 8 wherein the indicia is formed in ink, or by screen printing, or in the form of a printed paper or decal.

11. The process of claim 8 wherein the plastic material includes acrylics, styrenes, polycarbonates, a combination of acrylics and styrenes, a combination of polycarbonates and acrylics, a combination of styrenes and polycarbonates, or a combination of acrylics, styrenes and polycarbonates.

12. The process of claim 8 wherein the plastic material is a thermoplastic material.

13. The process of claim 12 wherein the thermoplastic material is styrene acrylonitrile or acrylic.

14. The process of claim 8 wherein the container is a drinking vessel.

15. The process of claim 14 wherein the drinking vessel is a cup, tumbler or mug.

16. A process for preparing an injection molded container having a protected advertising surface comprising:

(a) forming in a first injection mold a liner from styrene acrylonitrile or acrylic, the liner having a bottom, an interior, an exterior and a rim;

(b) removing the liner from the injection mold;

(c) placing an indicia on the exterior of the liner;

(d) placing the liner in a second injection mold; and (e) forming an injection molded outer layer of translucent or transparent styrene acrylonitrile or acrylic surrounding and fusing to the exterior of the liner including the rim to provide an integral container.

17. The process of claim 16 wherein the container is a mug, cup, tumbler, coaster, or coin container.

18. An integral injection molded product having a protected advertising surface comprising:

(a) a plastic liner having a bottom, an interior, an exterior and a rim, the exterior having a tab adjacent the rim;

(b) an indicia on the exterior of the liner registrally placed with respect to the tab; and (c) an injection molded outer layer of translucent or transparent plastic material surrounding and fused to the exterior of the liner including the rim to provide an integral product having a visible protected advertising surface.

19. The product of claim 18 wherein the injection molded product is a drinking vessel.

20. The product of claim 19 wherein the drinking vessel is a mug.

21. The product of claim 19 wherein the drinking vessel is a cup.

22. The product of claim 18 wherein the plastic material is styrene acrylonitrile or acrylic.

23. An integral injection molded container having a protected advertising surface comprising:

(a) a plastic liner having a bottom, an interior, an exterior and a rim, the interior having a vertical small flat edge;

(b) an indicia on the exterior of the liner registrally placed with respect to the interior vertical small flat edge; and (c) an injection molded outer layer of translucent or transparent plastic material surrounding and fused to the exterior of the liner including the rim to provide an integral container with a visible protected advertising surface.

24. The product of claim 23 wherein the container is a mug.

25. The product of claim 23 wherein the container is a cup.

26. The product of claim 23 wherein the plastic material is styrene acrylonitrile or acrylic.

* * * * *